United States Patent [19]

Kumasaka

[11] 3,961,771

[45] June 8, 1976

[54] MECHANICAL GUY CABLE CONTROL DEVICE

[75] Inventor: Archie M. Kumasaka, Middletown, N.J.

[73] Assignee: The United States of America as represented by the Secretary of the Army, Washington, D.C.

[22] Filed: June 18, 1975

[21] Appl. No.: 588,089

[52] U.S. Cl. ..... 254/184; 254/173 R; 188/134; 52/121

[51] Int. Cl.[2] ..... B66D 1/26

[58] Field of Search..... 254/139, 143, 184, 173 R, 254/148, 134.3 R; 188/1 B, 134; 116/173; 248/499; 52/121; 74/675; 182/230; 187/1 R

[56] References Cited

UNITED STATES PATENTS

| | | | |
|---|---|---|---|
| 3,145,864 | 8/1964 | Arnold | 254/184 |
| 3,588,050 | 6/1971 | Black | 254/184 |
| 3,898,817 | 8/1975 | Capewell et al. | 188/134 |

*Primary Examiner*—Robert J. Spar
*Assistant Examiner*—Kenneth Noland
*Attorney, Agent, or Firm*—Nathan Edelberg; Sheldon Kanars; Daniel Sharp

[57] ABSTRACT

For the purpose of maintaining verticality during erection of antenna masts and the like, opposing guy control cables having corresponding ends secured to the top mast section are directed onto a pair of capstans which in turn are coupled to the input elements of a pair of Weston brakes, arranged in back-to-back relation on a common support, and whose output elements are coupled to the sun gears of an intervening planetary gear differential. The other ends of the two guy control cables wrapped on the capstans are wound and stored on two cable reels arranged above the capstans on the common support, under control of a reel turning means employed to reel in the guy control cables during mast lowering or retraction.

10 Claims, 5 Drawing Figures

FIG. 3
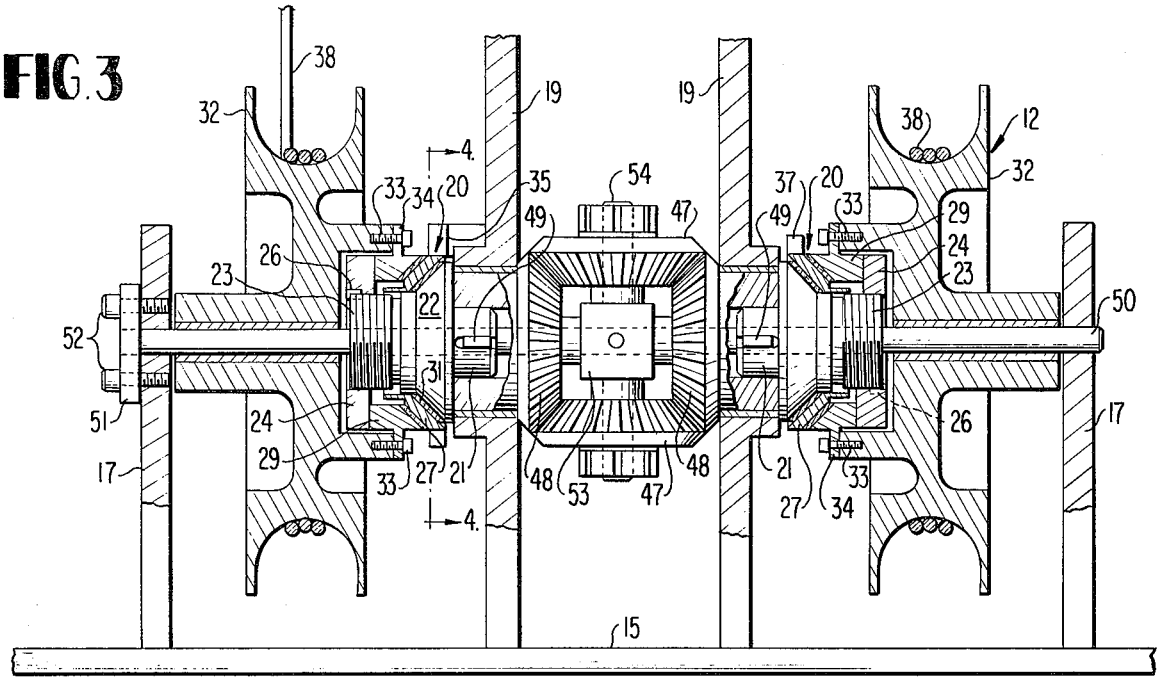
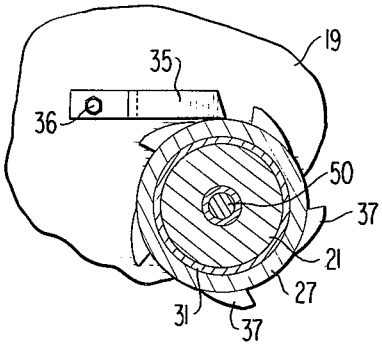
FIG. 4
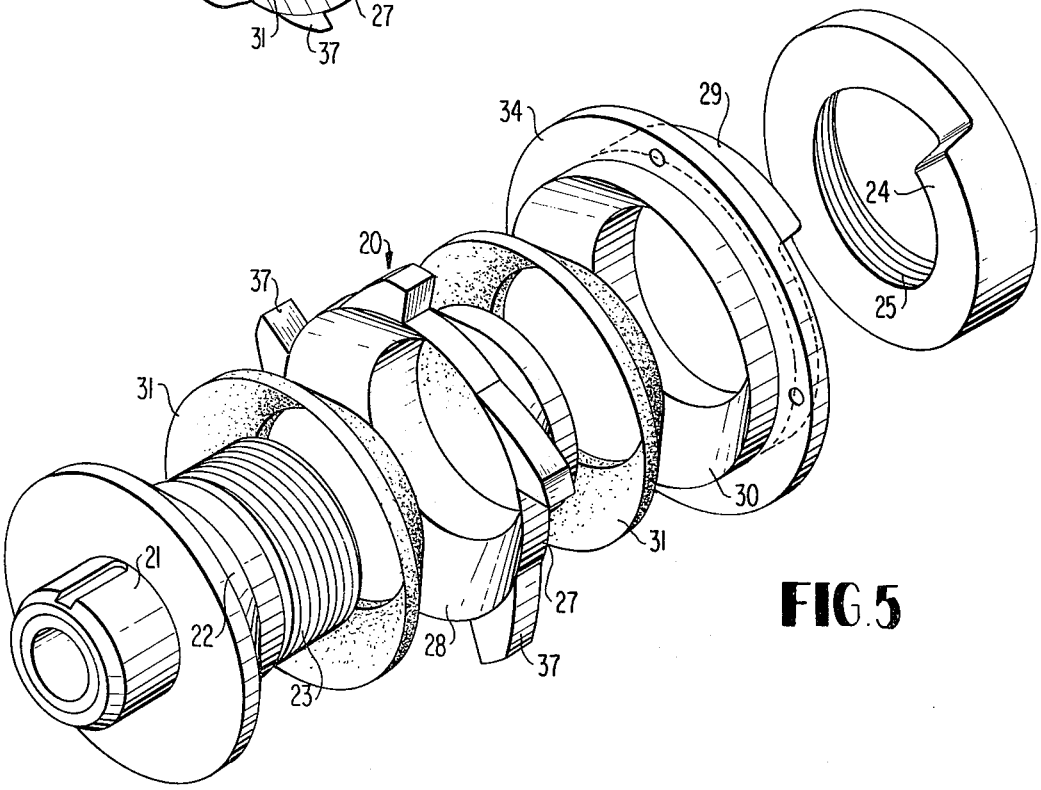
FIG. 5

MECHANICAL GUY CABLE CONTROL DEVICE

The invention described herein may be manufactured and used by or for the Government for governmental purposes without the payment of any royalties thereon or therefor.

Background of the Invention

1. Field of the Invention

This invention relates to a mechanism for controlling the verticality of antenna masts and the like during their erection, by responding automatically to the effects of wind loads or other horizontal force components on the mast, to assure safe operation during erection and retraction procedures.

2. Description of the Prior Art

It has been customary in the prior art to control the guy cables of antenna masts during mast erection and retraction procedures by employing one or two men at each anchor position, resulting in the assignment of up to eight additional men for a single mast erection or retraction. Such controlling of paired guy cables is absolutely essential for safe operation and to insure mast survivability where antenna payloads of as much as 200 pounds are extended to heights of 70 to 125 feet. As an alternative to this excessive use of human personnel, some prior art efforts have been made to control the guy cables of extensible and retractable masts by electrically powered equipment, namely winches. Since many instances occur where electricity is not conveniently available, it has been recognized as desirable to provide an all-mechanical automatic guy cable control device to deal with the problem of variable wind loads on extensible and retractable masts or similar structures during the raising and lowering thereof. The prior art, as far as is known, has failed to provide a satisfactory device for this purpose, and it is therefore the objective of the invention to provide a simplified, practical and economical device or mechanism for this purpose, which will eliminate the need for employing excessive personnel as well as the need for electrical power.

Summary

Briefly summarized, the invention consists of a support structure secured near one side of the base of an extensible and retractable vertical mast. On this support are mounted in back-to-back orientation a pair of one way freewheeling and one way positive locking brake units of the Weston brake type. Such mechanical brake units are quite well known in the art in a variety of forms and generally involve an output rotary component including a ratchet wheel which is free turning in one direction and a cooperating pawl which locks the entire system against turning in the opposite direction. The ratchet wheel is intervened between friction plates or discs which are backed up by drive and load shoes. The brake unit additionally embodies an input rotary component including a drive cam which, under certain circumstances of torque loading, will force the friction discs and associated shoes into active braking engagement.

In the invention, the output components of the one way freewheeling and one way locking brake units are coupled to the sun gears of an intervening planetary gear differential, whose planet gears are restrained on the support and not free to revolve around the sun gears. A pair of guy control cable capstans are mounted on and turn with the input components of the two brake units and several wraps of cable are wound on these capstans, with corresponding ends thereof leading to overhead cable storage reels also mounted on the aforementioned support. A hand crank with suitable gearing or some equivalent means is utilized to reel in the guy control cables on the two storage reels in opposite directions during mast lowering or retraction. The paying out of the guy control cables takes place automatically during mast erection.

The control cables are payed out oppositely from the two capstans and extend beyond opposite sides of the mast at ground level and are reeved about a pair of ground anchored guide pulleys from which the control cables extend upwardly in converging relation to the upper section of the mast to which their other corresponding ends are secured. As will be more apparent from the following detailed description of the invention, a closed loop control arrangement is provided for each opposing pair of guys including the back-to-back Weston brake units and associated differential.

By means of the invention, the mast may be raised with facility and without electrical power or manual power to control the wind effects on the mast. If no wind is present, equal lengths of cable will be drawn from the two opposing cable reels and both capstans will input equal torques to their respective Weston brakes, resulting in free brake action, since input and output torques are equal (excluding friction). If a wind is present, one guy will be under greater tension than the opposing guy. This results in increased torque at the input of the adjacent brake unit with no braking action as it passes through. However, when the torque enters the second brake unit of the back-to-back pair of brakes through the output or load shaft, and the input torque for this brake coming from the leeward guy is of smaller magnitude, then that particular Weston brake will lock. This causes the ratchet wheel to engage its pawl, which then locks the entire system against further rotation in that direction. To reactivate the system, an input torque is required from that capstan on which the leeward guy is wrapped, sufficient to unlock the associated brake and free both cables for further pay out. This input torque is supplied by further raising the mast, which increases tension in the leeward cable.

BRIEF DESCRIPTION OF THE DRAWINGS

FIG. 3 is a central vertical cross section taken through the guy cable control mechanism and its support structure.

FIG. 4 is a fragmentary vertical section taken on line 4—4 of FIG. 3.

FIG. 5 is an exploded perspective view of one Weston brake assembly.

Description of the Preferred Embodiment

Figure 2:
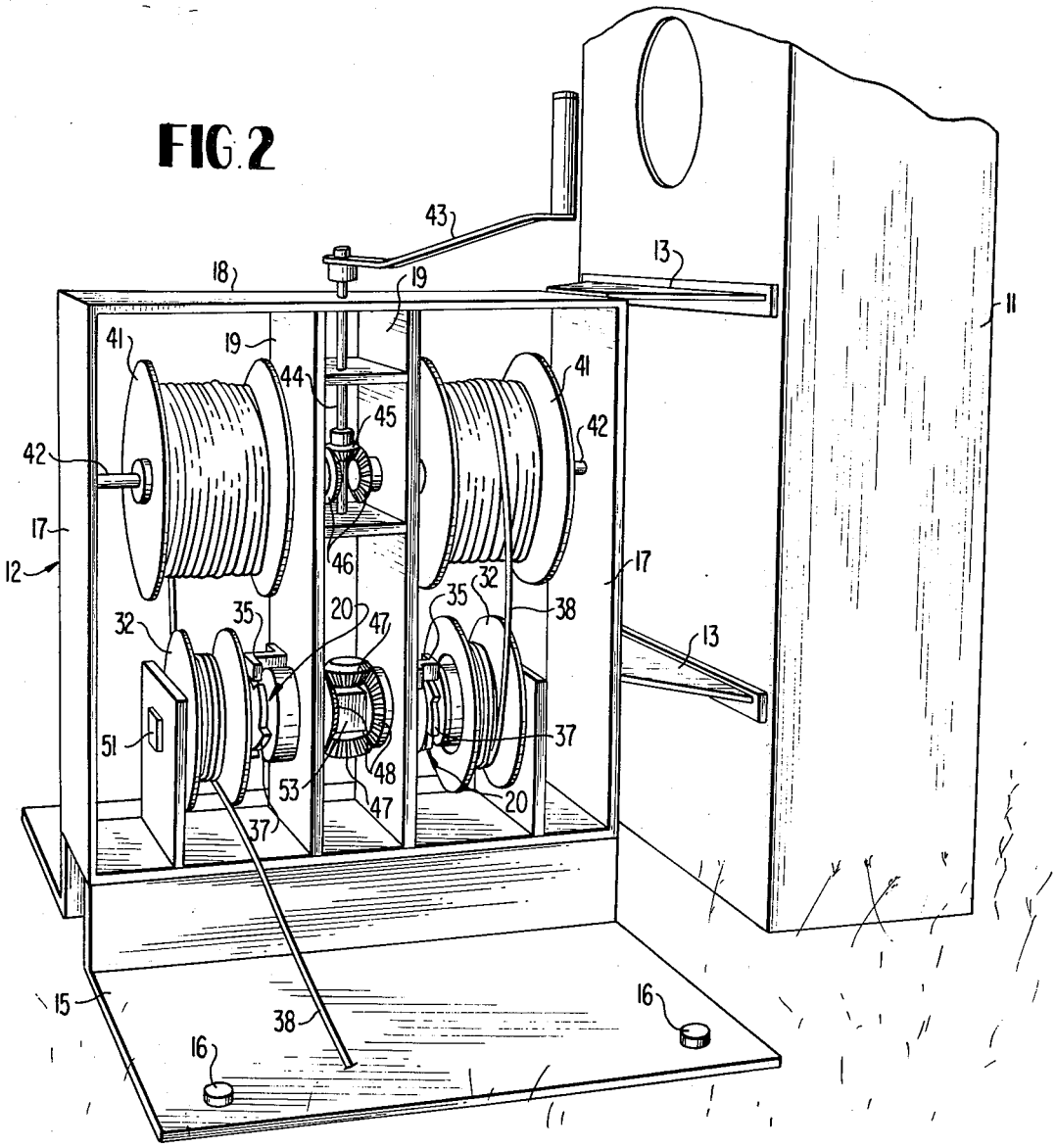
FIG. 2 is an enlarged fragmentary perspective view of the guy cable control mechanism arranged at one side of the mast base.

Referring to the drawings in detail wherein like numerals designate like parts, the numeral 10 designates a vertically extensible and retractable antenna mast of a type which when fully erected may be required to support a 200 pound antenna structure at a height of 100 feet more or less. The invention herein is concerned with maintaining verticality of the mast during its erection or lowering, in both still and windy conditions. The mast includes a firmly anchored base section 11 or launcher and the invention guy cable control device 12 is positioned close to one side of the mast base and may be stabilized relative thereto by bracket elements 13 or the like. The device 12 has a rigid support frame including base plate means 15 resting on the ground and adapted to be anchored to the ground by plural anchoring elements 16, as best shown in FIG. 2. The support frame includes vertical side plates 17, a top horizontal plate 18 and a pair of spaced intermediate vertical plates 19. All of these frame components are joined to form a rigid support structure for the guy cable control mechanism, now to be described in detail.

The control mechanism or device 12 comprises a pair of substantially conventional Weston brake assemblies 20 arranged in axially opposing back-to-back relation, FIG. 3, with their output components arranged inwardly and their input components outwardly in the mechanism assembly.

Referring particularly to FIG. 5, each Weston brake assembly 20 comprises an output shaft 21 having a conically tapered friction brake shoe 22 and a screw-threaded extension 23. A first cam element 24 has a screw-threaded bore 25 receiving the threaded extension 23 and keyed or locked thereto in assembly as indicated at 26 in FIG. 3. A toothed ratchet 27 having a conically tapered face 28 and a second cam element 29 having a conically tapered brake shoe face 30 are both disposed between the output shaft 21 and the first-named cam 24 in the assembled device. Conically tapered friction brake discs 31 are also included between the opposing conical faces of the elements 22, 27 and 29.

Referring to FIG. 3, an input capstan 32 for each Weston brake assembly is secured as at 33 to a radial flange 34 of each cam element 29. The cooperating end faces of the two cam elements 24 and 29 are engaged in the assemblies 20 so that relative rotation of the cam elements in one direction will tend to squeeze or compress the friction discs 31 axially with the conical portion of the ratchet 27.

A pair of gravity urged pawls 35 are pivoted as at 36 to the adjacent support plates 19 so that these pawls may positively lock the ratchet 27 against rotation in one direction by engagement with the ratchet teeth 37, while allowing free rotation in the opposite direction.

Figure 1:
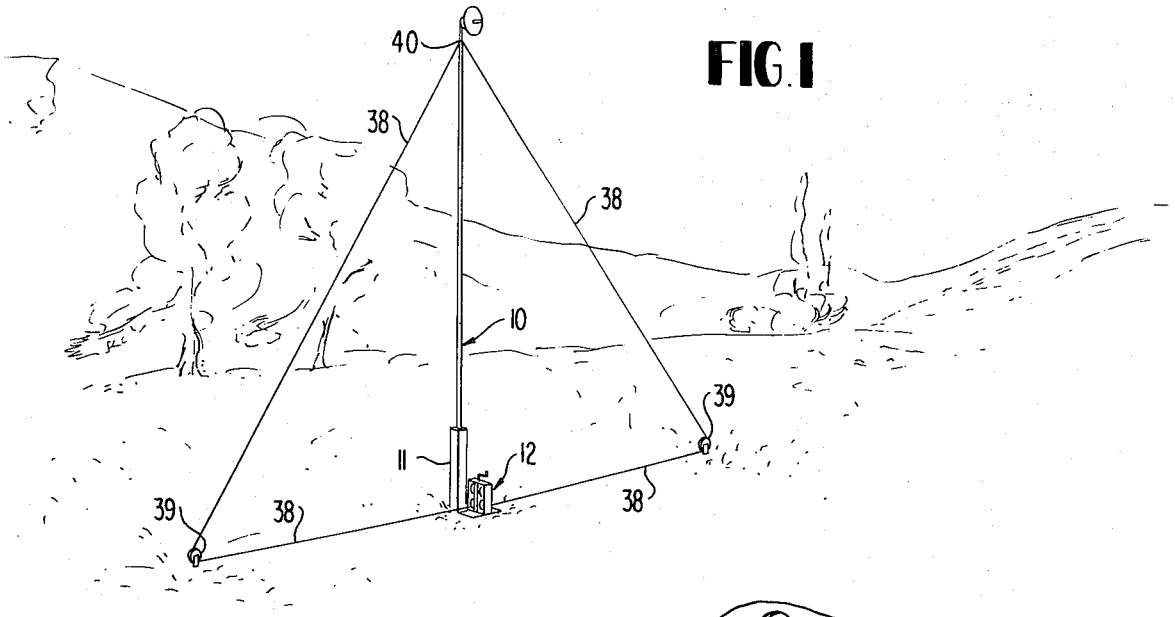
FIG. 1 is a perspective view of a vertically extensible and retractable mast with the mechanical guy cable control device forming the present invention.

Several wraps of a coacting pair of guy cables 38 are placed on each capstan 32, with corresponding ends of the cables extending oppositely from the bottoms of the capstans, substantially horizontally near ground level. These cable portions are trained around a pair of guide pulleys 39, spaced equidistantly from opposite sides of the mast 10 and being suitably anchored in the ground. From these guide pulleys, the cables extend upwardly in converging relation, FIG. 1, and each cable is secured to the top section of the extensible and retractable mast 10, as at 40 in FIG. 1.

The remote corresponding ends of the two guy control cables 38 extend upwardly from opposite sides of the capstans 32, FIG. 2, to a pair of overhead cable storage reels 41 on the support frame of the mechanism. The cables stored on these two reels are payed out automatically and reeled in according to a mode of operation to be further described. Each reel 41 is carried by a horizontal rotary shaft 42 on the support frame, and the two reels are adapted to be turned oppositely in unison to reel in cable by a hand crank 43 secured to the top of a vertical rotary shaft 44, journaled on the support frame and carrying a driving bevel gear 45, meshing with two driven bevel gears 46 on the respective shafts 42 of the two cable reels. As will be explained, hand crank 43 is utilized only during the lowering of the mast 10 to reel in the two guy control cables 38. The paying out of these cables during the raising of the mast is automatic.

Disposed between the two back-to-back Weston brake assemblies 20 and between the vertical plates 19 is a planetary gear differential having planet gears 47 and sun gears 48. The two sun gears 48 are coupled as by keys 49, FIG. 3, with the output shafts 21 of the previously-described Weston brake assemblies 20. Thus, two power paths exist through each brake assembly; an input power path from a capstan 32 through cam element 29 and the associated friction brake means including discs 31 and ratchet 27, and a second output power path through a sun gear 48, shaft 21 and cam element 24 which is coupled to the threaded portion 23 of shaft 21. The arrangement is such, during the operation of the Weston brake assemblies, that torques from the load or output shafts 21 are reflected back through the cooperating cams 24 and 29 to cause axial compression of the friction brake discs 31 against ratchet 27 and therefore activation of the brake and locking of the brake by the pawl means 35. The brake can be released subsequently by application of a torque of smaller magnitude (approximately 20%) to the capstan 32.

A continuous horizontal support shaft 50 for the mechanism extends axially through all of the components of the two brake assemblies 20 and through the hubs of the sun gears 48. The shaft 50 has its ends supported on the vertical plates 17 of the support frame and is held against rotation by a head 51 on one end of the shaft, held against turning relative to the plate 17 by a pair of screws 52 or the like. In addition to forming a basic support for the capstans 32 and brake assemblies 20 in the mechanism, the shaft 50 which does not rotate is utilized to restrain rotation of the planet gears 47 around the sun gears 48. A block element 53 carrying the shaft 54 on which the planet gears 47 rotate is suitably locked on the stationary shaft 50 so that the planet gears, while free to turn on their axes, are prevented from traveling around the sun gears 48 during the operation of the device.

Operation

When the mast 10 is being extended or raised in a calm wind condition, equal tension will be exerted on the two guy control cables 38 by the top section of the mast, and equal lengths of cable will be drawn automatically from the two reels 41. As this occurs, both capstans 32 with which the two cables are engaged will input equal torques to their respective Weston brakes 20, resulting in freewheeling brake status in the proper direction for mast elevation, since input and output torques are equal (excluding friction).

If significant wind is present, one cable 38 will be under greater tension than the opposing cable 38. This results in increased torque at the input of the adjacent brake assembly 20, through the element 29, with no braking action occurring as the applied torque passes through. However, when the torque enters the second Weston brake assembly in the back-to-back arrangement of brakes on the output or load shaft 21 thereof, and the input torque coming from the leeward guy cable 38 to the second brake is of smaller magnitude, then the second brake 20 will lock or become active responsive to cam action. This causes engagement of the ratchet 27 with the adjacent pawl 35 resulting in locking of the entire system against further rotation in that direction. The initial activation of the second brake 20 is produced by coaction of the cam elements 24 and 29 causing axial squeezing of the friction discs 31 against the conical faces of ratchet 27. Following this, the system is positively locked by coaction of the ratchet teeth 37 with pawl 35.

To release the locked system, an input torque is required from the capstan 32 on which the leeward cable 38 is wrapped, and such input torque will unlock the adjacent Weston brake 20 and thus free both cables 38 for further pay out as the mast 10 rises. In fact, this further input torque necessary to unlock the system is derived from further raising of the mast and further tensioning of the leeward cable 38 as a result of mast extension.

In actuality, the braking action will occur intermittently throughout the erection process, with the lock up and release through the brakes 20 providing a relatively smooth motion at the top of the mast and not a jerky motion.

The lowering of the mast requires no additional effort other than the reeling in of the guy control cables 38. Brake action is not involved normally during lowering, but the brake system would be activated instantly should a sudden gust of wind impinge on the mast, increasing the tension in the windward cable, thereby locking the opposite or leeward brake.

In the disclosed embodiment of the invention, the hand crank 43 is utilized to reel in the guy control cables 38 during mast lowering, as previously mentioned. In some instances, the cable reeling operation could be accomplished by utilizing energy from a spring motor, or could be derived from the descent of the mast through a flexible cable connected with the mast gear box, not shown, which governs the lowering of the mast. Various alternative arrangements in the constructional details of the mechanism throughout may be resorted to without departing from the substance of the invention.

As should now be apparent, a completely mechanical device is provided to automatically maintain verticality in an extensible and retractable structure as the structure is raised and lowered in calm air or windy conditions. The availability of electrical power is not required, nor is manual power required on the guy cables, as has been customary in the prior art. The entire mechanism is simple, compact and rugged and is relatively economical to manufacture. The mechanism is efficient and entirely practical.

While a single pair only of cables 38 and associated mechanism 12 has been shown and described, it should be understood that additional opposing pairs of cables may be employed in association with the mast 10 along with additional units of the invention mechanism 12.

Having thus described what is at present considered to be the preferred embodiment of the subject invention

What is claimed is:

1. A guy element control mechanism for vertically extensible and retractable structures subject to varying wind loads during extension and retraction, said mechanism comprising a support means adapted to be fixed near the base of a vertically extensible and retractable structure, a pair of opposing flexible guy elements having corresponding ends adapted for attachment to a top section of a vertically extensible and retractable structure, guide means for said flexible guy elements positioned substantially equal distances from opposite sides of a base of a structure, a pair of capstans on the support means and each receiving convolutions of one of said flexible guy elements, storage reel means for the flexible guy elements on the support means in spaced relation to the capstans and receiving the other corresponding ends of the flexible guy elements to complete a closed loop guy system with a vertically extensible and retractable structure, a pair of one way freewheeling and one way locking rotary brake assemblies on the support means each having input and output rotary components, said capstans being secured to said input components of the brake assemblies to turn therewith, and a differential gear means disposed between said brake assemblies including gear components drivingly coupled with said output components of the brake assemblies, the output components of the brake assemblies being in back-to-back relationship axially on said support means, said brake assemblies being operable when the input torque of a given capstan is greater than the input torque of the other capstan.

2. A guy element control mechanism as defined in claim 1, and additional power means on said support means and drivingly connected to the storage reel means to facilitate turning such reel means to reel in the flexible guy elements during retraction of a structure with which the guy elements are connected.

3. A guy element control mechanism as defined in claim 2, and wherein the storage reel means comprises a pair of horizontal axis guy element storage reels on said support means above said capstans, said capstans having a common horizontal axis of rotation.

4. A guy element control mechanism as defined in claim 3, and said guide means for said flexible guy elements comprising a pair of ground anchored pulleys near the elevation of said capstans.

5. A guy element control mechanism as defined in claim 4, and said additional power means including gearing drivingly connected with said pair of guy element storage reels for turning the same oppositely on their rotational axes.

6. A guy element control mechanism as defined in claim 1, and each brake assembly including between its input and output components a toothed ratchet and friction brake means engaging the ratchet, a cooperating locking pawl for said ratchet mounted on said support means, and a one way active cam means operable to activate the friction brake means in response to a feed back of torque to the output component.

7. A guy element control mechanism as defined in claim 6, and said differential gear means comprising a planetary differential having planet and sun gears, the sun gears of the differential being coaxial with the capstans and brake assemblies and being coupled to the output components of the brake assemblies.

8. A guy element control mechanism as defined in claim 7, and a shaft on said support means extending axially through the capstans, brake assemblies and said sun gears and assisting in the guidance and support of such elements on the support means.

9. A guy element control mechanism as defined in claim 8, and means interconnecting said shaft to the support means fixedly, and restraining means for said planet gears coupled with said shaft and allowing rotation of the planet gears on their axes but preventing them from traveling circumerentially around said sun gears.

10. A guy element control mechanism as defined in claim 6, and each locking pawl comprising a gravity urged pivoted pawl on the support means.

* * * * *